US009560461B2

(12) United States Patent
Davis et al.

(10) Patent No.: US 9,560,461 B2
(45) Date of Patent: Jan. 31, 2017

(54) AUTOMATIC LOUDSPEAKER POLARITY DETECTION

(71) Applicants: DOLBY LABORATORIES LICENSING CORPORATION, San Francisco, CA (US); DOLBY INTERNATIONAl AB, Amsterdam Zuidoost (NL)

(72) Inventors: Mark F. Davis, Pacifica, CA (US); Louis Fielder, Millbrae, CA (US); Antonio Mateos Sole, Barcelona (ES); Giulio Cengarle, Barcelona (ES); Sunil Bharitkar, Los Angeles, CA (US)

(73) Assignees: Dolby Laboratories Licensing Corporation, San Francisco, CA (US); Dolby International AB, Amsterdam Zuidoost (NL)

( * ) Notice: Subject to any disclaimer, the term of this patent is extended or adjusted under 35 U.S.C. 154(b) by 0 days.

(21) Appl. No.: 14/761,906

(22) PCT Filed: Jan. 17, 2014

(86) PCT No.: PCT/US2014/012069

§ 371 (c)(1),
(2) Date: Jul. 17, 2015

(87) PCT Pub. No.: WO2014/116518

PCT Pub. Date: Jul. 31, 2014

(65) Prior Publication Data

US 2015/0365775 A1 Dec. 17, 2015

Related U.S. Application Data

(60) Provisional application No. 61/756,088, filed on Jan. 24, 2013.

(51) Int. Cl.
*H04R 29/00* (2006.01)
*H04S 7/00* (2006.01)
*H04S 3/00* (2006.01)

(52) U.S. Cl.
CPC ..... *H04R 29/001* (2013.01); *H04R 29/002* (2013.01); *H04S 7/00* (2013.01); *H04S 3/00* (2013.01)

(58) Field of Classification Search
CPC ..... H04R 29/001; H04R 29/002
See application file for complete search history.

(56) References Cited

U.S. PATENT DOCUMENTS 3,067,297 A * 12/1962 Fink ..... H04R 29/00 381/1
4,908,868 A * 3/1990 McTaggart ..... H04R 5/04 327/3

(Continued)

FOREIGN PATENT DOCUMENTS

WO 2012/063104 5/2012
WO 2013/006324 1/2013

*Primary Examiner* — Brenda Bernardi

(57) ABSTRACT

In some embodiments, a method for automatic detection of polarity of speakers, e.g., speakers installed in cinema environments. In some embodiments, the method determines relative polarities of a set of speakers (e.g., loudspeakers and/or drivers of a multi-driver loudspeaker) using a set of microphones, including by measuring impulse responses, including an impulse response for each speaker-microphone pair; clustering the speakers into a set of groups, each group including at least two of the speakers which are similar to each other in at least one respect; and for each group, determining and analyzing cross-correlations of pairs of impulse responses (e.g., pairs of processed versions of impulse responses) of speakers in the group to determine relative polarities of the speakers. Other aspects include systems configured (e.g., programmed) to perform any (Continued)

embodiment of the inventive method, and computer readable media (e.g., discs) which store code for implementing any embodiment of the inventive method.

12 Claims, 4 Drawing Sheets

(56) References Cited

U.S. PATENT DOCUMENTS

| | | | | |
|---|---|---|---|---|
| 5,319,714 | A * | 6/1994 | McTaggart | H04R 29/001 381/59 |
| 6,681,019 | B1 * | 1/2004 | Kitano | H04R 5/04 381/123 |
| 7,734,054 | B2 * | 6/2010 | Asada | H04R 29/001 381/58 |
| 2006/0050891 | A1 * | 3/2006 | Bharitkar | H04R 29/001 381/59 |
| 2006/0062399 | A1 * | 3/2006 | McKee Cooper | G01S 11/14 381/58 |
| 2006/0262940 | A1 | 11/2006 | Asada | |
| 2010/0119075 | A1 | 5/2010 | Xiang | |
| 2010/0239099 | A1 * | 9/2010 | Yonemoto | H04S 7/00 381/59 |
| 2011/0299691 | A1 * | 12/2011 | Yoshino | H04R 29/00 381/59 |
| 2012/0224701 | A1 | 9/2012 | Sakai | |
| 2014/0119551 | A1 * | 5/2014 | Bharitkar | H04H 60/33 381/59 |

* cited by examiner

AUTOMATIC LOUDSPEAKER POLARITY DETECTION

CROSS-REFERENCE TO RELATED APPLICATIONS

This application claims priority to U.S. Provisional Patent Application No. 61/756,088, filed on 24 Jan. 2013, which is hereby incorporated by reference in its entirety.

TECHNICAL FIELD

The invention relates to systems and methods for detecting polarity of loudspeakers of an audio playback system. Typical embodiments are systems and methods for automatic detection of polarity of loudspeakers installed in cinema (movie theater) environments.

BACKGROUND

The cinema sound industry is currently undergoing a significant change, from widespread use of multi-channel loudspeaker systems having a small number of channels (e.g., 5.1 or 7.1 channel systems having five or seven full-range channels) to use of new systems that provide many more channels (typically, N full-range channels, where $12 \leq N \leq 64$). Such new systems, in which loudspeakers are typically located over the whole hemisphere above listeners, allow precise location and motion of sounds within the hemisphere, and can recreate more realistic "3D" ambiences and reverbs. Herein, we will sometimes use the expression "many-channel system" (in contrast with "multi-channel" system) to refer to a system of the new type, in which the number of full-range channels is much greater than 7.

It is expected that, in typical use, many-channel systems will pan sound sources based on amplitude-panning which, for a given sound source, strongly depends on the coherence in the signals arriving from the few loudspeakers (a subset of the large set of installed loudspeakers) which participate in the reproduction. Even in systems as simple as stereo, the perceived location of a sound intended to be panned between speakers can be rendered vaguely, or even outside the area between the speakers, if the responses (amplitude and phase) of the two speakers are incorrectly matched.

It is therefore essential for the current worldwide deployment of the new many-channel speaker systems to have technology available for ensuring that all channels in a given playback venue are properly matched. Most existing equalization processes focus on correcting the amplitude response of the different channels, which ensures a correct match of timbre perception across channels. However, to ensure proper sound imaging across the entire system, the matching of the phase response of each channel needs to be addressed.

One of the most common problems encountered in many-channel installations is that the polarity of a number of channels is inverted. This is normally due to either incorrect wiring during the set up stage, or to incorrect wiring inside one of the components of the audio chain. The latter is more difficult to detect and fix by the installer, as all visible wiring is actually correct. In both cases, however, the sound imaging will be seriously compromised when channels having incorrect speaker polarity participate in sound panning.

Furthermore, in a multi-way active or passive loudspeaker system (having multiple drivers), polarity inversion can affect only one of the drivers. When wrong polarity takes place in the bass driver, the sound imaging can be as severely compromised as when the whole loudspeaker polarity system is inverted, as well-known in the psychoacoustics literature. It is therefore important to ensure correct polarity matching not only across channels, but also across different drivers in a single channel.

It is important to implement loudspeaker polarity detection to be automatic and to avoid taking extra time. The inventors have recognized that in order to implement quick and automatic loudspeaker polarity detection, the use of tone bursts or asymmetric signals (as in the paper D. B. Keele, Jr., "Measurement of Polarity Band-Limited Systems," presented at the 91st Audio Engineering Society Convention in New York, Oct. 4-8, 1991) should be avoided.

With the expected increase of the number of channels to be installed in typical playback venues, the possibilities of wrong-polarity problems increase accordingly. Unfortunately, the time required to set up a many-channel speaker system may be long. As a result, it is expected that many-channel system installers will often have less time to check and correct wrong-polarity issues. Therefore, it would be desirable to provide methods that, on one hand, perform such checks automatically, and on the other hand, do not have a significant impact on the time needed for setting up. The latter restriction favors methods that do not require the emission and capturing of additional signals specifically tailored for polarity analysis, and instead are capable of re-using the measurements normally performed during conventional initial calibration or alignment (sometimes referred to as equalization or theater equalization) of a newly installed speaker array.

Finally, it is desirable that automatic methods for determining loudspeaker polarity be robust to choices of the type, and position(s) in a playback venue, of the measuring microphone(s), as well as robust to natural differences in the details of the phase response due to the presence of different loudspeaker models in the venue and differences in the positions of the loudspeakers in the venue. Unfortunately, delays, reverberation, and noise have made conventional polarity checking methods inaccurate and/or otherwise problematic.

A conventional method for automatic determination of loudspeaker phase is described in US Patent Application Publication No. 2006/0050891, published on Mar. 9, 2006. This method includes steps of driving a speaker with an impulse, capturing the resulting emitted sound using a microphone, determining an impulse response (from the speaker to the microphone) from the captured audio, and determining polarity of the speaker by determining the sign of the first peak of the impulse response (the first peak having an amplitude whose absolute value exceeds a predetermined threshold). If the sign of the first peak's amplitude is positive, the method determines that the speaker has positive polarity. However, this method is subject to the limitation that it does not determine quality of the measured impulse response, and thus can undesirably determine a speaker polarity from a wrongly measured response (e.g., a response indicative of noise only).

BRIEF DESCRIPTION OF EXEMPLARY EMBODIMENTS

In typical embodiments, the invention is a method for automatic detection of relative polarity of loudspeakers of an audio playback system (e.g., loudspeakers installed in a cinema environment). Typical embodiments of the inventive method can be performed in home environments as well as in cinema environments, e.g., with the required signal processing of microphone output signals being performed in a home theater device (e.g., an AVR or Blu-ray player that is shipped to the user with the microphone(s) to be employed to perform the method).

In a first class of embodiments, the invention is a method for determining relative polarities of (e.g., polarity inversions between) a set of N speakers (e.g., of a many-channel or other multi-channel playback system) in a playback environment using a set of M microphones in the playback environment, where M is a positive integer (e.g., M=1 or 2) and N is an integer greater than one. The method typically detects polarity inversions between channels, where each of the channels comprises a speaker (e.g., a full-range speaker including one or more drivers), and can also detect polarity inversions between specific drivers in at least one channel (i.e., between drivers of a single multi-driver speaker). In typical embodiments in the first class, the method includes steps of:

(a) measuring impulse responses, including an impulse response for each speaker-microphone pair. Typically, this is done by driving each of the speakers with a wideband stimulus (e.g., an impulse, or a noise signal or sine wave sweep if an impulse-determining algorithm is used), and obtaining audio data indicative of sound captured by each of the microphones during emission of sound from each driven speaker, and determining the impulse responses by processing the audio data;

(b) clustering the speakers into a set of groups (one group or multiple groups), each group in the set including at least two of the speakers which are similar to each other in at least one respect; and (c) for each said group, determining cross-correlations of pairs of the impulse responses of speakers in the group and determining relative polarity of the speakers in said group from the cross-correlations.

Since a cross-correlation of two impulse responses, each having a domain, is a function having the same domain, the terms "cross-correlation" and "cross-correlation function" are used interchangeably herein. If the speakers (loudspeakers or drivers) corresponding to a pair of compared impulse responses are in phase, the peak value of the cross-correlation function of the responses is a positive value in a range between 0 and 1.0 (this assumes a normalized cross-correlation function whose positive values are in the noted range. We shall assume that the cross-correlation functions referred to herein are so normalized). If the speakers corresponding to a pair of compared impulse responses are 180 degrees out of phase, the peak value of the cross-correlation function of the responses is a negative value in a range between 0 and −1.0. In typical embodiments, step (c) includes a step of determining (for each of the groups) a peak value of the cross-correlation of each pair of impulse responses corresponding to two speakers in the group, determining that the two speakers are in phase upon determining that the peak value is positive and exceeds a predetermined positive threshold value (typically the positive threshold value is in the range from 0.3 to 0.5), and determining that the two speakers are out of phase upon determining that the peak value is negative and has an absolute value which exceeds the predetermined positive threshold value.

Typically, each microphone generates an analog output signal, and the audio data are generated by sampling each said analog output signal. Preferably, the audio data are organized into frames having a frame size adequate to obtain sufficient low frequency resolution.

Optionally, processing is performed on the impulse responses (or on the raw microphone output signals) before the cross-correlations are determined and analyzed. Typically, the outcome of the method is a list of speakers in each group with inverted polarity (i.e., relative to the polarity of a representative speaker in the group), where the list indicates inverted polarity either on a per speaker (full-band) basis or a per driver basis (where the speakers include drivers of multi-driver loudspeakers). The list may indicate not only speakers that are in-phase or anti-phase, but also speakers that have no clear polarity relation with other speakers, which can indicate a defective speaker. Such a list can be used by an automatic correction algorithm, or simply to flag warnings for a speaker system installer.

The use of cross-correlation analysis provides several advantages over other techniques (e.g., peak detection, time-delay estimation, and phase analysis), including robustness and provision of continuous estimation.

The clustering (sometimes referred to herein as grouping) of compared speakers is an important step of typical embodiments of the invention. Cross-correlation analysis can be fully exploited only when used together with grouping. Without grouping, cross-correlations could be determined from pairs of impulse responses of speakers which are very different (e.g., because they are of different types or models, such as, for example, in-screen speakers and surround speakers, or because they are located in very different positions), which would always yield very low peak cross-correlation values and would not provide useful results indicative of relative polarity. Clustering of compared speakers allows cross-correlation analysis to be restricted to groups of similar speakers and thus increases the effectiveness of the inventive method in determining relative polarity.

The clustering performed in typical embodiments of the invention is typically one of two different types:

clustering based on data indicative of characteristics of speakers (e.g. their position in the room, the type of each speaker, and so on). This type of clustering is sometimes referred to herein as "Type 1 clustering." The data on which Type 1 clustering is based is typically predetermined and can be generated (or provided to a processor which implements the inventive method) in any of a variety of different ways, e.g., by reading a manually written file, or by inference from measured impulse responses (e.g., by deriving position in the room from measured impulse responses, and inferring from measured impulse responses whether the speakers being measured are full-bandwidth or not); and clustering in accordance with an algorithm which depends on cross-correlations (e.g., peak values of cross-correlations) determined from impulse responses of pairs of speakers. This type of clustering is sometimes referred to herein as "Type 2 clustering." The general aim of Type 2 clustering is to form subgroups with high inter-speaker correlation values. Whereas Type 1 clustering assumes that similar speaker positions and responses will lead to high cross-correlation values, Type 2 clustering directly uses measured cross-correlation values.

The clustering performed in some embodiments of the invention is a combination of both Type 1 and Type 2 clustering (e.g., initial clustering based on data indicative of characteristics of speakers followed by modification of the initially determined clusters based on measured cross-correlation values, or contemporaneously performed Type 1 and Type 2 clustering). For example, if cross-correlation analysis finds an absence of clear correlation for a speaker compared to others in an initially determined cluster, that speaker may be removed from the cluster and placed in another cluster.

In typical embodiments, extra signal processing is performed on determined impulse responses prior to cross-correlation calculation, either to increase robustness and significance of cross-correlation values, or to allow the algorithm to detect polarity inversions of individual drivers in a single (multi-driver) loudspeaker. As explained in detail below, such signal processing typically includes at least one of the following: band-pass filtering to select the relevant driver; time windowing (also referred to herein as gating or windowing) to reduce room effects, and weighting (e.g., logarithmic weighting) of frequency bands to avoid over-weighting high-frequencies. The time windowing may be frequency-dependent time-windowing. Time windowing may also be used to reduce noise effects by eliminating periods in an acquired recording where there is no signal, just noise.

Two time windowing operations are typically performed. The first gates the raw recording, which need not be an impulse (usually it is not an impulse, since impulses typically have low SNR), and usually has a "silent" period before and after the stimulus which is dominated by room and microphone noise. The first gating removes the silent periods from the recording prior to derivation of the impulse response. The first gating usually requires time alignment of the raw microphone recording with the original stimulus. After derivation of a full length impulse response (which may be several seconds in duration), the second gating reduces the duration of (or otherwise windows) the impulse response to remove further noise and room effects.

The time windowing performed in some embodiments comprises multiplying the impulse response by a function that provides a fade-in and fade-out. Time windowing is typically frequency dependent, e.g., a longer impulse response is retained at low frequencies while a shorter one is retained at high frequencies.

In some embodiments, the invention is a method for detecting relative polarities of a set of speakers (e.g., of each of driver of a set of multi-driver loudspeakers), said method including steps of:

1. driving each of the speakers in turn with a wideband stimulus, and obtaining audio data indicative of sound captured by at least one microphone during emission of sound from each driven speaker. Typically, each of the speakers is driven in turn with the wideband stimulus, sound emitted from each of the driven speakers is captured using one or more microphones, and the captured audio (the output of each microphone) is recorded in clock synchrony with the assertion of the driving stimulus to the sequence of speakers;

2. determining an impulse response from each speaker (loudspeaker or driver thereof) to each microphone from the audio data (e.g., the raw recordings). The averaging implicit in this operation helps suppress any noise present in the recordings, although room reverberation is preserved;

3. preferably, the impulse responses are time windowed to remove sections dominated by room reflections. Typically, the window periods extend from −1 msec to 2.5 msec (relative to the initial peak) for wideband speakers, and −10 msec to 25 msec for subwoofers. The windowing also results in faster processing;

4. For each microphone, cross correlation functions are calculated for pairs of the speaker (loudspeaker or driver) impulse responses, and determining relative phase of pairs of the speakers from the cross-correlation functions. Optionally, the impulse responses are equalized and/or bandpass filtered before the cross correlation functions are determined. Although speakers in different positions typically have different, uncorrelated reverberation tails, determination of the cross correlations tends to suppress the reverberation, and thus provides polarity-dependent cross-correlation results. Typically, the peak value of the cross-correlation of each pair of impulse responses (corresponding to two speakers) is determined, and the method includes steps of determining that the two speakers are in phase upon determining that the peak value of the cross-correlation is positive and exceeds a predetermined positive threshold value (typically the positive threshold value is in the range from 0.3 to 0.5), and determining that the two speakers are out of phase upon determining that the peak value of the cross-correlation is negative and has an absolute value which exceeds the predetermined positive threshold value.

Optionally also, at least one of the following steps is also performed:

5. in ambiguous cases, cross-correlation functions determined from a pair of speakers (loudspeakers or drivers) are surveyed across at least three microphones used, and a voting paradigm is used (i.e., a voting operation or weighted averaging is performed) to select a final polarity for the pair of speakers (e.g., where a cross-correlation is determined for each of N microphones, where N is an odd integer greater than 2, the polarity indicated by the majority of the N cross-correlations is selected as the polarity for the pair of speakers); and 6. since speakers of dissimilar models may occasionally result in a false positive indication of polarity (either positive or negative) when there is no well-defined wideband polarity relationship, the compared speakers (loudspeakers or drivers) are separated into different groups, each group consisting of speakers between which there is a strong correlation as indicated by the cross-correlation functions determined for pairs of the speakers (this is an example of Type 2 clustering). Typically, speakers are assigned to different groups if no strong correlation is indicated by the cross-correlation function determined (using any microphone) for the speakers. The risk of a false positive (false indication of positive or negative relative polarity) can be mitigated by comparing the cross correlation between each speaker (preliminarily assigned to a first group) and each of a set of other speakers (including speakers assigned to at least one other group), and re-assigning the speaker into a different group if a stronger, more consistent polarity indication is found from cross-correlations of the speaker with speakers in the different group. Grouping may also depend on the observed frequency response (e.g., a wideband speaker and a subwoofer should be placed in different groups). In some circumstances a system configuration file may be available with information about the speakers whose polarities are to be compared, which can then be used to refine the assignment of the speakers into groups.

In another class of embodiments (implementing Type 1 clustering), the invention is a method for detecting polarity of each loudspeaker of a set of loudspeakers, said method including the steps of:

1. driving each of the speakers with a wideband stimulus, and obtaining audio data indicative of sound captured by at least one microphone during emission of sound from each driven speaker. Typically, each of the speakers is driven in turn with the wideband stimulus, sound emitted from each of the driven speakers is captured using one or more microphones, and the captured audio (the output of each microphone) is recorded in clock synchrony with the assertion of the wideband stimulus to the sequence of speakers;

2. determining an impulse response from each speaker (loudspeaker or driver thereof) to each microphone from the audio data (e.g., the raw recordings). The averaging implicit in this operation helps suppress any noise present in the recordings, although room reverberation is preserved;

3. preferably, the impulse responses are time windowed to remove sections dominated by room reflections. Typically, the window periods extend from −1 msec to 2.5 msec (relative to the initial peak) for wideband speakers, and −10 msec to 25 msec for subwoofers;

4. determining groups of the speakers (loudspeakers or drivers) in response to data indicative of characteristics of the speakers (e.g. their positions in the room, the type of each speaker, etc.). Such data is typically predetermined and can be generated (or provided to a processor which implements the inventive method) in any of a variety of different ways. For example, the data can be read from a manually written file, or inferred from the measured impulse responses (from an impulse response, one can typically infer a loudspeaker's position in the room, whether it is full-bandwidth or not, and so on); and 5. selecting a representative speaker of each group of the speakers, computing the position of the maximum of the absolute value of each cross-correlation between the representative speaker and each other speaker in the group, and computing the sign of each of each said cross-correlation at each said position. If the sign is negative, a speaker of a group is determined to have inverse polarity relative to the polarity of the representative of the group. Cross-correlation functions involving a pair of speakers can be surveyed across all microphones used, and a voting paradigm can be used (i.e., a voting operation or weighted averaging can be performed) to select the final polarity for the pair.

Optionally, at least one the following processing operations is performed on determined impulse responses or raw microphone output signals (before determination of cross-correlation functions from the processed impulse responses or the impulse responses determined from the processed microphone output signals):

bandpass filtering of either the raw recordings or the impulse responses, to focus the cross-correlation analysis in different parts of the spectra. The parameters of the bandpass filter can optionally be set according to known cross-over frequencies;

pre-processing the spectra of the raw recordings or the impulse responses (e.g., by logarithmic weighting of the frequency bands), so as to give similar weight to all octaves, e.g., by multiplying the spectra by a −3 dB per octave filter. Unless such a process is performed, the cross-correlation weights high frequencies much more than low frequencies, thus leading to low success in detection of bass-driver-only polarity problems; and time gating (possibly frequency dependent time gating) of the impulse responses. This processing (sometimes referred to herein as windowing) typically increases the index obtained in cross-correlations, as it filters out the part of the impulse response that is due to first rebounds and reverberation. Thus, robustness is enhanced by considering only the direct sound arriving from each loudspeaker.

These three types of processing steps can be combined among themselves and with other processing steps. We do not restrict to a specific order of the optional signal processing operations (bandpass filtering, frequency weighting, and windowing). They can be performed in any desired order, except in that the windowing process does not commute (leads to very different results) with the others so that if a sequence of the processing operations includes windowing, the sequence should be determined to achieve the desired result.

In a second class of embodiments of the inventive method, polarity of speakers of a playback system is determined by determining phase as a function of frequency of measured, time-gated impulse responses. In this class, the method includes steps of:

1. driving each of the speakers in turn with a wideband stimulus, capturing resulting sound emitted from each of the speakers using one or more microphones, and recording the captured audio (the output of each microphone) in clock synchrony with the assertion of the wideband stimulus to the sequence of speakers;

2. determining an impulse response from each speaker (loudspeaker or driver thereof) to each microphone from the captured audio (e.g., the raw recordings), and generating a time-gated impulse response in response to each said impulse response by time-gating the impulse response to remove sections dominated by room reflections; and 3. determining relative polarity of each of the speakers as a function of frequency from at least one said time-gated impulse response for said each of the speakers, by determining whether the phase, at each frequency of interest, of the time-gated impulse response more closely approximates 0 or 180 degrees (indicating non-inverted or inverted polarity, respectively). In typical embodiments, determination of the relative polarity of each speaker (at each frequency) includes one of the following two operations:

performing minimum-phase flattening on the frequency response of the time-gated impulse response for the speaker to determine a flattened time-gated impulse response (typically, the flattening step removes the phase component arising from the minimum-phase values of the speaker or the room to focus the analysis only on phase differences arising from polarity differences), and determining the relative polarity to be non-inverted (i.e., relative to the polarity of some representative speaker) if the absolute level of the maximum (or first) peak of a bandpass filtered version of the flattened time-gated impulse response for the speaker (with the pass band centered at the relevant frequency) is positive, and determining the relative polarity to be inverted (i.e., relative to the polarity of the representative speaker) if the absolute level of the maximum (or first) peak of the bandpass filtered version of the flattened time-gated impulse response corresponds to a negative value; or determining time delay of the time-gated impulse response for the speaker (i.e., time of occurrence of the first (or maximum) positive peak of the impulse response relative to time of emission of the driving impulse, assuming that the driving impulse has positive peak amplitude), performing coarse delay correction (and optionally also additional delay correction) on the time-gated impulse response using the time delay to determine a corrected impulse response, wherein the additional delay correction includes adding or subtracting a small additional delay so the unwrapped phase of the phase response of the corrected impulse response at some high frequency (e.g., 15 kHz or 20 kHz) is at least substantially equal to zero (after both the coarse and additional delay correction have been performed), and determining the relative polarity to be non-inverted (relative to the polarity of some representative speaker) at a frequency of interest if the phase of the corrected impulse response is in the range $-90\ \text{deg} \leq \text{phase} < 90\ \text{deg}$, and determining the relative polarity to be inverted (relative to the polarity of the representative speaker) at the frequency of interest if the phase of the corrected impulse response is in the range $90\ \text{deg} \leq \text{phase} \leq 180\ \text{deg}$, or the range $-180\ \text{deg} \leq \text{phase} < -90\ \text{deg}$. The additional time delay correction is typically performed in the frequency domain by performing a time domain-to-frequency domain transform on the time-gated impulse response for a speaker, determining the phase spectrum, and subtracting the linear phase shift as a function of frequency associated with the delay from the phase values of the time-gated impulse response for the speaker.

The second class of embodiments of the inventive method has the advantage of being intrinsically frequency selective. Evaluation of polarity at each frequency of a set of frequencies, over the entire audio frequency range, has the benefit of being able to detect polarity for each individual driver or crossover of a multi-driver loudspeaker.

Typically, for each speaker, the method is performed on a set of time-gated impulse responses, each from the speaker to a different one of a set of at least two microphones, and the final polarity score for each frequency of interest (the center frequency of each passband) for the speaker is based on majority vote or weighted average of the bandpass filtered, time-gated impulse response phase assessments for all microphones.

In a third class of embodiments of the inventive method, polarity of speakers in a playback environment (e.g., speakers of a playback system) is determined using a peak tracking technique to determine the first peak of an impulse response which has been measured for each speaker. In this class, the method includes steps of driving a speaker with a wideband stimulus, capturing the resulting sound emitted from the speaker using a microphone, determining an impulse response (from the speaker to the microphone) from the captured audio, and determining polarity of the speaker by determining the sign of the first peak of the impulse response whose amplitude has an absolute value which exceeds a predetermined threshold. The method determines absolute polarity of each speaker, if it is known or assumed that a positive going first peak in the direct part of the impulse response for a speaker corresponds to positive polarity and a negative going first peak in the direct part of the impulse response for the speaker corresponds to a negative polarity (assuming a positive polarity microphone). Each method in this class also provides an indication of the quality of each impulse response based on inter-microphone loudspeaker-room impulse response analysis. In typical implementations, the quality of each impulse response used to determine polarity is determined by an iteration index ("j+1") which indicates the number of iterations required for iterative determination of the impulse response's first peak.

Typical embodiments in the third class include the steps of:

(a) driving a speaker with a wideband stimulus, and capturing resulting sound emitted from the speaker using at least one microphone, thereby generating an output signal for each said microphone;

(b) for each said microphone, determining from the microphone's output signal a sequence of audio values indicative of an impulse response (from the speaker to the microphone);

(c) from each said sequence of audio values, determining polarity of the speaker by determining the sign of the first peak (indicated by the sequence) whose amplitude has an absolute value exceeding a predetermined threshold; and (d) determining a measure of quality of the impulse response, where step (c) includes the steps of:

(e) determining a subset of the values in the sequence such that each value in the subset has an absolute value exceeding the predetermined threshold value, and determining a time (e.g., a time index identifying one of the values) corresponding to a value in the subset which has a maximal absolute value (i.e., determining the time corresponding to a value in the subset which has absolute value equal to or greater than the absolute value of all other the values in the subset); and (f) generating a reduced subset of the values by discarding all values in the subset corresponding to times later than the time determined in step (e) until the reduced subset consists of a single value, identifying said single value as the first peak indicated by the sequence, and determining the sign of said single value, and wherein step (d) includes the step of determining a number A*(j+1)+B, where j is the number of iterations of steps (e) and (f) performed to determine the reduced subset of the values which consists of a single value of the reduced subset, * denotes multiplication, and A and B are non-negative numbers (e.g., A=1 and B=0), and identifying the number A*(j+1)+B as the measure of quality of the impulse response.

Aspects of the invention include a system configured (e.g., programmed) to perform any embodiment of the inventive method, and a computer readable medium (e.g., a disc) which stores code for implementing any embodiment of the inventive method.

In some embodiments, the inventive system is or includes at least one microphone (each said microphone being positioned during operation of the system to perform an embodiment of the inventive method to capture sound emitted from a set of speakers whose polarity is to be determined), and a processor coupled to receive a microphone output signal from each said microphone. The processor can be a general or special purpose processor (e.g., an audio digital signal processor), and is programmed with software (or firmware) and/or otherwise configured to perform an embodiment of the inventive method in response to each said microphone output signal. In some embodiments, the inventive system is or includes a general purpose processor, coupled to receive input audio data (e.g., indicative of output of at least one microphone in response to sound emitted from a set of speakers to be monitored). The processor is programmed (with appropriate software) to generate (by performing an embodiment of the inventive method) output data in response to the input audio data, such that the output data are indicative of status of the speakers.

NOTATION AND NOMENCLATURE

Throughout this disclosure, including in the claims, the expression performing an operation "on" signals or data (e.g., filtering, scaling, or transforming the signals or data) is used in a broad sense to denote performing the operation directly on the signals or data, or on processed versions of the signals or data (e.g., on versions of the signals that have undergone preliminary filtering prior to performance of the operation thereon).

Throughout this disclosure including in the claims, the expression "system" is used in a broad sense to denote a device, system, or subsystem. For example, a subsystem that implements a decoder may be referred to as a decoder system, and a system including such a subsystem (e.g., a system that generates X output signals in response to multiple inputs, in which the subsystem generates M of the inputs and the other X−M inputs are received from an external source) may also be referred to as a decoder system.

Throughout this disclosure including in the claims, the following expressions have the following definitions:

speaker and loudspeaker are used synonymously to denote any sound-emitting transducer. Thus, a speaker (or loudspeaker) can be implemented as multiple transducers or drivers (e.g., woofer and tweeter) or as a single transducer or driver;

speaker feed: an audio signal to be applied directly to a loudspeaker, or an audio signal that is to be applied to an amplifier and loudspeaker in series;

channel (or "audio channel"): a monophonic audio signal;

audio program: a set of one or more audio channels and optionally also associated metadata that describes a desired spatial audio presentation; and render: the process of converting an audio program into one or more speaker feeds, or the process of converting an audio program into one or more speaker feeds and converting the speaker feed(s) to sound using one or more loudspeakers (in the latter case, the rendering is sometimes referred to herein as rendering "by" the loudspeaker(s)).

DETAILED DESCRIPTION OF EXEMPLARY EMBODIMENTS

Many embodiments of the present invention are technologically possible. It will be apparent to those of ordinary skill in the art from the present disclosure how to implement them. Embodiments of the inventive system and method will be described with reference to FIGS. 1-5.

Figure 3:
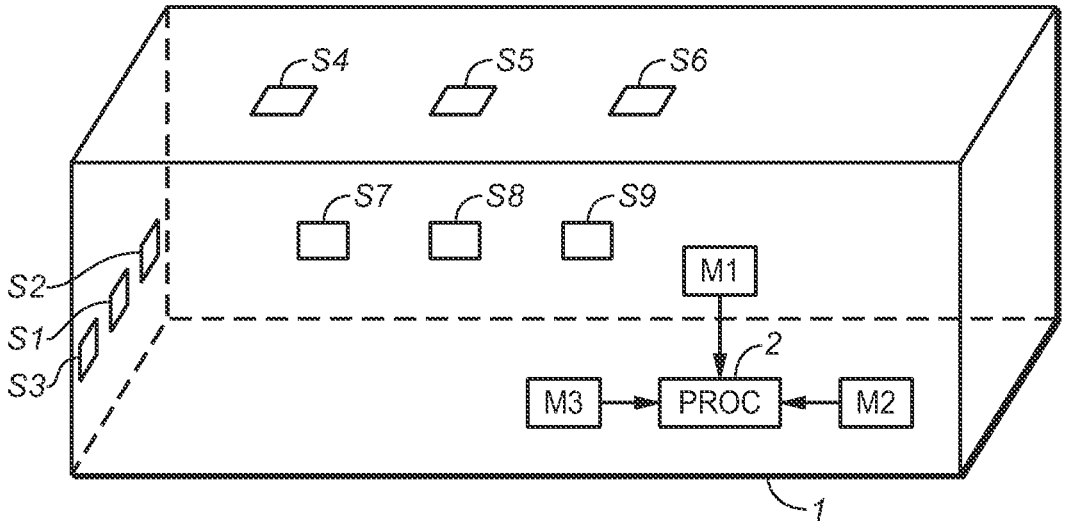
FIG. 3 is a diagram of playback environment 1 (a room which may be a movie theater) in which speakers S1-S9 (and optionally also additional speakers) are installed, and microphones M1, M2, and M3 and programmed processor 2 are positioned. An embodiment of the inventive system includes processor 2 and microphones M1-M3 coupled thereto, with processor 2 programmed to perform an embodiment of the inventive method on samples of the output of each of microphones M1-M3.

We shall describe exemplary embodiments in more detail with reference to FIG. 3. The embodiments determine relative polarity of N loudspeakers (including loudspeakers S1, S2, S3, S4, S5, S6, S7, S8, and S9, and typically also additional loudspeakers) or of individual drivers of each of the loudspeakers which includes multiple drivers, using a set of M microphones (including microphones M1, M2, and M3, and optionally also additional microphones) and a programmed processor 2 coupled to the microphones. Each of the microphones is configured to produce a microphone output signal in response to incident sound. The audio data processed by processor 2 to perform the inventive method are generated by sampling the output signal of each of the microphones. Sampling can be performed in the processor or in another element of the system (e.g., in each of the microphones). Processor 2 may output (or be provided with) the signal which drives each speaker (or a scaled or other version of each such signal), and processor 2 may use each such signal with the output of each of the microphones to implement typical embodiments of the invention.

The exemplary methods are typically performed in a room 1, which may be a movie theater or playback environment. As shown in FIG. 3, three loudspeakers (S1, S2, and S3) and typically also a display screen (not shown) are mounted on the front wall of room 1. Additional loudspeakers (typically including at least one subwoofer) are mounted elsewhere in the room. The output of each of microphones M1, M2, and M3 is processed (by appropriately programmed processor 2 coupled thereto) in accordance with an embodiment of the inventive method.

In exemplary embodiments, the invention is a method for detecting relative polarities of (e.g., polarity inversions between) speakers of a multi-channel (e.g., many-channel) playback system. The method typically detects polarity inversions between channels, where each of the channels comprises a speaker (e.g., a full-range speaker including one or more drivers), and can also detect polarity inversions between specific drivers in at least one channel (i.e., between drivers of a single multi-driver speaker, e.g., a multi-driver implementation of one of speakers S1-S9). The method includes steps of measuring impulse responses of the speakers, clustering of the speakers whose impulse responses are measured into a set of groups (one group or multiple groups), each of the groups including at least two speakers, and analyzing cross-correlations of the impulse responses (e.g., processed versions of the impulse responses) of each of the groups to determine relative polarity of the speakers in said each of the groups. Optionally, processing is performed on the impulse responses (or on the raw microphone output signals) before the cross-correlations are determined and analyzed. Typically, the outcome of the method is a list of speakers with inverted polarity, where the list indicates inverted polarity either on a per speaker (full-band) basis or a per driver basis. Such a list can be used by an automatic correction algorithm, or simply to flag warnings for a speaker system installer.

The use of cross-correlation analysis provides several advantages over other techniques (e.g., peak detection, time-delay estimation, and phase analysis), including robustness and provision of continuous estimation.

The cross-correlation analysis is more robust than conventional analysis in which peaks of impulse responses are measured and the sign of each peak is detected. This is because, although peaks in impulse responses can (undesirably) be detected even in wrongly measured responses (e.g., responses indicative of noise only), cross-correlations between such wrongly measured responses would yield very low values (in which case they would typically not be interpreted as being indicative of relative polarity). Also, the sign of a detected peak of an impulse response (undesirably) depends strongly on the high-frequency content of the response, whereas cross-correlations between impulse responses only yields high values when the entire compared signals are similar. Furthermore, for distributed-surround speakers (multiple speakers which are fed by a single, common signal), peak detection methods can yield ambiguous results whereas cross-correlation analysis would provide useful results.

Cross-correlation analysis naturally yields a continuous estimation, rather than just a binary result (an indication of positive or negative polarity), which naturally quantifies how similar are the responses of the compared channels. Whereas peak detection forces decisions even in uncertain cases, continuous polarity estimation allows the algorithm to operate more intelligently.

Clustering (sometimes referred to herein as grouping) of compared speakers is an important step of typical embodiments of the invention. Cross-correlation analysis can be fully exploited only when used together with grouping. Without grouping, cross-correlations could be performed on impulse responses of speakers which are very different (e.g., because they are of different types or models, such as, for example, in screen speakers and surround speakers, or because they are located in very different positions), which would always yield very low values of cross-correlation and would not provide useful results indicative of relative polarity. Clustering of measured speakers allows cross-correlation analysis to be restricted to groups of similar speakers and thus increases the effectiveness of the inventive method in determining relative polarity.

The clustering performed in typical embodiments of the invention can be either one of two different types:

clustering based on data indicative of characteristics of measured speakers (e.g. their positions in the room, the type or model of each speaker, and so on). This type of clustering is sometimes referred to herein as "Type 1 clustering." The data on which Type 1 clustering can be based is typically predetermined and can be generated (or provided to a processor which implements the inventive method) in any of a variety of different ways, e.g., by reading a manually written file, or by inference from measured impulse responses (e.g., by deriving position in the room from measured impulse responses, and inferring from measured impulse responses whether the speakers being measured are full-bandwidth or not). Examples of possible resulting groups include the following: screen speakers, wall surround speakers, ceiling speakers, and subwoofers; and clustering in accordance with an algorithm which depends on cross-correlation values determined from impulse responses of pairs of measured speakers. This type of clustering is sometimes referred to herein as "Type 2 clustering." The general aim of Type 2 clustering is to form subgroups with high inter-speaker correlation values. Whereas Type 1 clustering assumes that similar speaker positions and responses will lead to high cross-correlation values, Type 2 clustering directly uses measured cross-correlation values.

Figure 1:
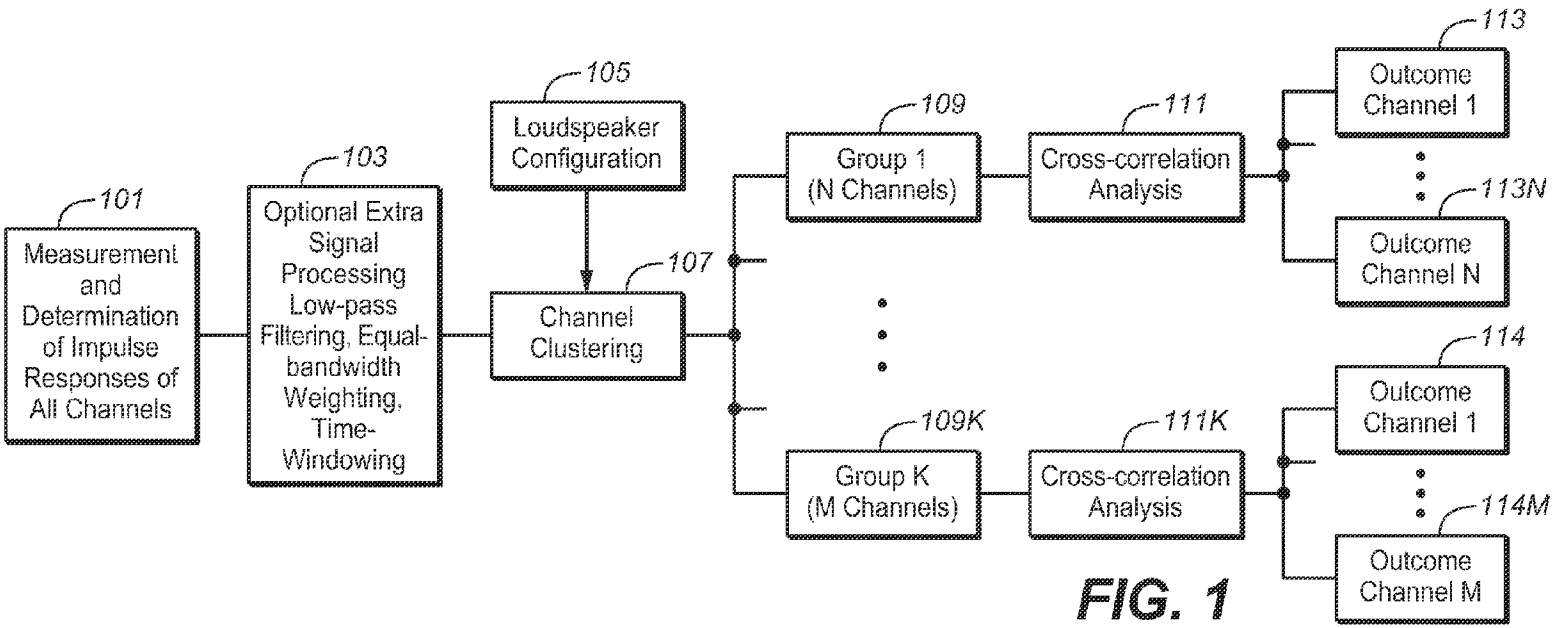
FIG. 1 is a flow chart of steps performed during speaker polarity determination in accordance with a class of embodiments of the invention which implement Type 1 clustering.

FIG. 1 is a diagram of speaker polarity determination in accordance with a class of embodiments of the invention which implement Type 1 clustering.

Figure 2:
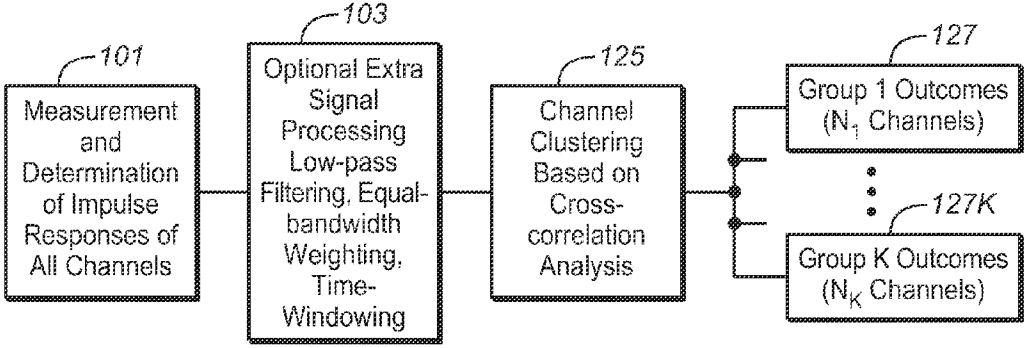
FIG. 2 is a flow chart of steps performed during speaker polarity determination in accordance with a class of embodiments of the invention which implement Type 2 clustering.

FIG. 2 is a diagram of speaker polarity determination in accordance with a class of embodiments of the invention which implement Type 2 clustering.

In typical embodiments of the invention, extra signal processing is performed on measured impulse responses prior to determining cross-correlations between the responses (or otherwise determining speaker polarities from them), e.g., to increase robustness and significance of cross-correlation values determined from the responses, or to allow embodiments of the inventive method to detect polarity inversions of individual drivers in a single (multi-driver) loudspeaker. As explained in detail below, such signal processing typically includes at least one of the following: band-pass filtering to select the relevant driver; time windowing (e.g., frequency-dependent time-windowing) to reduce room effects, and weighting (e.g., logarithmic weighting) of frequency bands to avoid overweighting high-frequencies.

In a class of embodiments (including the FIG. 2 embodiment), the invention is a method for detecting relative polarities of a set of speakers (e.g., of each of driver of a set of multi-driver loudspeakers), said method including steps of:

1. driving each of the speakers in turn with a wideband stimulus, capturing resulting sound emitted from each of the speakers using one or more microphones, and typically also recording the captured audio (the output of each microphone) in clock synchrony with the assertion of the wideband stimulus to the sequence of speakers;

2. determining an impulse response from each speaker (or driver thereof) to each microphone from the captured audio (e.g., the raw recordings). The averaging implicit in this operation helps suppress any noise present in the recordings, although room reverberation is preserved. Step 101 of FIG. 2 implements these steps 1 and 2;

3. preferably, the impulse responses are time windowed to remove sections dominated by room reflections. Typically, the window periods extend from −1 msec to 2.5 msec (relative to the initial peak) for wideband speakers, and −10 msec to 25 msec for subwoofers. The windowing also results in faster processing. Optional step 103 of FIG. 2 typically implements windowing of the impulse responses determined in step 101;

4. For each microphone, cross correlation functions are calculated for pairs of the speaker (loudspeaker or driver) impulse responses. Optionally, the impulse responses are equalized and/or bandpass filtered before the cross correlation functions are determined. Step 125 of FIG. 2 implements such determination of cross-correlation functions of each pair of impulse responses. Although speakers in different positions typically have different, uncorrelated reverberation tails, determination of the cross correlations tends to suppress the reverberation, and thus provides polarity-dependent cross-correlation results. If the compared speakers (loudspeakers or drivers) are in phase, the peak of the correlation function of the speakers' responses will be positive and approach a value of 1.0. If the compared speakers (loudspeakers or drivers) are 180 degrees out of phase, the correlation peak will be negative and approach −1.0. A threshold value of the peak of the correlation function (typically a threshold value whose absolute value is in the range from 0.3 to 0.5) is used as a criterion for whether there is a positive (or negative) polarity relationship between the compared speakers.

Optionally also, at least one of the following steps is also performed:

5. in ambiguous cases, cross-correlation functions determined from a pair of speakers (loudspeakers or drivers) are surveyed across all microphones used, and a voting paradigm can be used (i.e., a voting operation or weighted averaging can be performed) to select a final polarity for the pair of speakers (e.g., where a cross-correlation is determined for each of N microphones, where N is an odd integer, the polarity indicated by the majority of the N cross-correlations is selected as the polarity for the pair of speakers); and 6. since speakers of dissimilar models may occasionally result in a false positive indication of polarity (either positive or negative) when there is no well-defined wideband polarity relationship, the compared speakers (loudspeakers or drivers) are separated into different groups, each group consisting of speakers between which there is a strong correlation as indicated by the cross-correlation functions determined for pairs of the speakers (this is an example of Type 2 clustering). Step 125 of FIG. 2 implements such grouping of speakers as well as determination of cross-correlation functions of each pair of speakers in each group, to determine a polarity for each speaker in each group (e.g., step 125 determines "K" groups of speakers from the cross-correlation functions also determined in step 125, where K is an integer greater than two, and step 125 determines polarity values 127 for each speaker in a first one of the groups, and polarity values 127K for each speaker in the "K" one of the groups, as indicated in FIG. 2). Typically, speakers are assigned to different groups if no strong correlation is indicated by the cross-correlation function determined (using any microphone) for the speakers. The risk of a false positive (false indication of positive or negative relative polarity) may be mitigated by comparing the cross correlation between each speaker (preliminarily assigned to a first group) and each of a set of other speakers (including speakers assigned to at least one other group), and re-assigning the speaker into a different group if a stronger, more consistent polarity indication is found from cross-correlations of the speaker with speakers in the different group. Ideally, this should involve a minimum number of comparisons, to minimize computation time. Grouping may also depend on the observed frequency response (e.g., a wideband speaker and a subwoofer should be placed in different groups). In some circumstances a system configuration file may be available with information about the speakers whose polarities are to be compared, which can then be used to refine the assignment of the speakers into groups.

In another class of embodiments (implementing Type 1 clustering), the invention is a method for detecting relative polarities of a set of speakers (e.g., of each of driver of a set of multi-driver loudspeakers), said method including the steps of:

1. driving each of the speakers in turn with a wideband stimulus, capturing resulting sound emitted from each of the speakers using one or more microphones, and typically also recording the captured audio (the output of each microphone) in clock synchrony with the assertion of the wideband stimulus to the sequence of speakers;

2. determining an impulse response from each speaker (loudspeaker or driver thereof) to each microphone from the captured audio (e.g., the raw recordings). The averaging implicit in this operation helps suppress any noise present in the recordings, although room reverberation is preserved. Step 101 of FIG. 1 implements these steps 1 and 2;

3. preferably, the impulse responses are time windowed to remove sections dominated by room reflections. Optional step 103 of FIG. 1 typically implements windowing of the impulse responses determined in step 101. Typically, the window periods extend from −1 msec to 2.5 msec (relative to the initial peak) for wideband speakers, and −10 msec to 25 msec for subwoofers;

4. determining groups of the speakers (loudspeakers or drivers) in response to data indicative of characteristics of the speakers (e.g. their positions in the room, the type of each speaker, etc.). Such data is typically predetermined and can be generated (or provided to a processor which implements the inventive method) in any of a variety of different ways. For example, the data can be read from a manually written file, or inferred from the measured impulse responses (from an impulse response, one can typically infer a loudspeaker's position in the room, whether it is full-bandwidth or not, and so on). Step 107 of FIG. 1 determines "K" groups of speakers (groups 109-109K as indicated in FIG. 1) from speaker configuration data 105, where K is an integer greater than one; and 5. selecting a representative speaker of each group of the speakers, computing the position of the maximum of the absolute value of each cross-correlation between the representative speaker and each other speaker in the group, and computing the sign of each of each said cross-correlation at each said position. If the sign is negative, a speaker of a group is determined to have inverse polarity relative to the polarity of the representative of the group. Each of steps 111-111K of FIG. 1 determines a representative speaker of a corresponding one of speaker groups 109-109K of FIG. 1, and calculates cross-correlation functions of speakers in the corresponding one of groups 109-109K. Step 111 determines relative polarity values 113-113N for the N speakers in group 109, and step 111K determines relative polarity values 114-114M for the M speakers in group 109K, as indicated in FIG. 1. Cross-correlation functions involving a pair of speakers can be surveyed across all microphones used, and a voting paradigm used to select the final polarity for the pair.

Optionally, at least one the following processing operations is performed on the determined impulse responses or raw microphone output signals (before determination of cross-correlation functions from the processed impulse responses or the impulse responses determined from the processed microphone output signals):

bandpass filtering of either the raw recordings or the impulse responses, to focus the cross-correlation analysis in different parts of the spectra. Optional step 103 of FIG. 1 (or FIG. 2) typically implements bandpass filtering of the impulse responses determined in step 101 of FIG. 1 (or FIG. 2). The parameters of the bandpass filter can optionally be set according to known cross-over frequencies;

pre-processing the spectra of the raw recordings or the impulse responses (e.g., by logarithmic weighting of the frequency bands), so as to give similar weight to all octaves, e.g., by multiplying the spectra by a −3 dB per octave filter. Optional step 103 of FIG. 1 (or FIG. 2) typically implements such equalization of the impulse responses determined in step 101 of FIG. 1 (or FIG. 2). In some cases, unless such a process is performed, the cross-correlation may weight high frequencies much more than low frequencies, thus leading to low success in detection of bass-driver-only polarity problems; and time gating (e.g., frequency dependent time gating) of the impulse responses. This processing (sometimes referred to herein as windowing) typically increases the index obtained in cross-correlations, because it filters out the part of each impulse response that is due to first rebounds and reverberation. Thus, robustness is enhanced by considering only the direct sound arriving from each loudspeaker. Optional step 103 of FIG. 1 (or FIG. 2) typically implements such windowing of the impulse responses determined in step 101 of FIG. 1 (or FIG. 2).

These three types of processing steps can be combined among themselves and with other processing steps. They are particularly useful to determine polarity of one driver (e.g., a woofer or bass driver) of a multi-driver loudspeaker relative to another driver (e.g., a tweeter) of the loudspeaker. For example, if the bass driver of a two-driver loudspeaker is wired incorrectly (to have inverse polarity relative to the polarity of the other driver), there is typically a considerable drop in the frequency response of the loudspeaker close to the cross-over frequency, as the cross-over filters strongly rely on having correct polarities in both drivers. This drop in frequency response can severely degrade the sound image created when such a loudspeaker participates jointly with others. The reason is that sound imaging strongly relies on phase coherence among loudspeakers at low frequencies (typically below 800 Hz). By employing the inventive method twice (for each microphone), once with the impulse response bandpass filtered with a passband below the crossover frequency (and optionally also with logarithmic weighting of the frequency bands, and/or time gating, of the impulse response), and another time with the impulse response bandpass filtered with a passband above the crossover frequency (and optionally also with logarithmic weighting of the frequency bands, and/or time gating, of the impulse response, the relative polarity of the two drivers can be determined.

The clustering performed in some embodiments of the invention is a combination of both Type 1 and Type 2 clustering (e.g., initial clustering based on data indicative of characteristics of speakers followed by modification of the initially determined clusters based on measured cross-correlation values, or contemporaneously performed Type 1 and Type 2 clustering). For example, if cross-correlation analysis finds an absence of clear correlation for a speaker compared to others in an initially determined cluster, that speaker may be removed from the cluster and placed in another cluster.

In typical embodiments, there are three possible outcomes to a correlation-based polarity analysis on a pair of speakers: in-phase, anti-phase, and no discernible relative phase (i.e., due to a low correlation peak, which could indicate a defective speaker). All speakers within a group (cluster) should have some discernible phase relationship, either plus or minus. Speakers with no phase relation to others in the group are split off into groups of their own. The grouping determination in typical embodiments combines Type 1 and Type 2 clustering into a single processing block that considers a configuration file along with correlation analysis to derive final groupings.

In some embodiments of the invention, the threshold used to determine correlation polarity is varied automatically during analysis, to adapt to varying signal conditions.

In a second class of embodiments of the inventive method, polarity of speakers of a playback system is determined by determining phase as a function of frequency of measured, time-gated impulse responses. Programmed processor 2 of FIG. 3 can be programmed to perform such an embodiment to determine relative polarities of speakers installed in room 1 (or of individual drivers of one or more such speakers). In this class, the method includes steps of:

1. driving each of the speakers in turn with a wideband stimulus, capturing resulting sound emitted from each of the speakers using one or more microphones, and recording the captured audio (the output of each microphone) in clock synchrony with the assertion of the wideband stimulus to the sequence of speakers;

2. determining an impulse response from each speaker (loudspeaker or driver thereof) to each microphone from the captured audio (e.g., the raw recordings), and generating a time-gated impulse response in response to each said impulse response by time-gating the impulse response to remove sections dominated by room reflections; and 3. determining relative polarity of each of the speakers as a function of frequency from at least one said time-gated impulse response for said each of the speakers, by determining whether the phase, at each frequency of interest, of the time-gated impulse response more closely approximates 0 or 180 degrees (indicating non-inverted or inverted polarity, respectively). In typical embodiments in the second class, determination of the relative polarity of each speaker (at each frequency) includes one of the following two operations:

(a) performing minimum-phase flattening on the frequency response of the time-gated impulse response for the speaker to determine a flattened time-gated impulse response (typically, the flattening step includes a step of performing time domain-to-frequency domain transform on the time-gated impulse response to determine the frequency response, and it removes the phase component arising from the minimum-phase values of the speaker or the room to focus the analysis only on phase differences arising from polarity differences), and determining the relative polarity to be non-inverted (i.e., relative to the polarity of some representative speaker) if the absolute level of the maximum (or first) peak of a bandpass filtered version of the flattened time-gated impulse response for the speaker (with the pass band centered at the relevant frequency) is positive, and determining the relative polarity to be inverted (i.e., relative to the polarity of the representative speaker) if the absolute level of the maximum (or first) peak of the bandpass filtered version of the flattened time-gated impulse response corresponds to a negative value; or (b) determining the time delay of the time-gated impulse response for the speaker (i.e., time of occurrence of the first (or maximum) positive peak of the impulse response relative to time of emission of the driving impulse, assuming that the driving impulse has positive peak amplitude), performing coarse delay correction (and optionally also additional delay correction) on the time-gated impulse response using the time delay to determine a corrected impulse response, wherein the additional delay correction includes adding or subtracting a small additional delay so the unwrapped phase of the phase response of the corrected impulse response at some high frequency (e.g., 15 kHz or 20 kHz) is at least substantially equal to zero (after both the coarse and additional delay correction have been performed), and determining the relative polarity to be non-inverted (relative to the polarity of some representative speaker) at a frequency of interest if the phase of the corrected impulse response is in the range $-90$ deg$\leq$phase$<90$ deg, and determining the relative polarity to be inverted (relative to the polarity of the representative speaker) at the frequency of interest if the phase of the corrected impulse response is in the range 90 deg$\leq$phase$\leq$180 deg, or the range $-180$ deg$\leq$phase$<-90$ deg. The additional time delay correction is typically performed in the frequency domain by performing a time domain-to-frequency domain transform on the time-gated impulse response for a speaker, determining the phase spectrum, and subtracting the linear phase shift as a function of frequency associated with the delay from the phase values of the time-gated impulse response for the speaker.

In typical embodiments in the second class which include the above-described operation (a), a flattened, time-gated impulse response is generated from each time-gated impulse response, by performing minimum-phase flattening on the frequency response of the time-gated impulse response, and the relative polarity of each of the speakers as a function of frequency is determined from the flattened, time-gated impulse response of said each of the speakers, by determining whether the phase, at each frequency of interest, of the flattened, time-gated impulse response more closely approximates 0 or 180 degrees. The flattening step removes the phase component arising from the minimum-phase values of the speakers or the room to focus the analysis only on phase differences arising from polarity differences.

The second class of embodiments of the inventive method has the advantage of being intrinsically frequency selective. Evaluation of polarity at each frequency of a set of frequencies, over the entire audio frequency range, has the benefit of being able to detect polarity for each individual driver or crossover of a multi-driver loudspeaker.

Typically, for each speaker, the method is performed on a set of time-gated impulse responses, each from the speaker to a different one of a set of at least two microphones, and the final polarity score for each frequency of interest (the center frequency of each passband) for the speaker is based on majority vote or weighted average of the bandpass filtered, time-gated impulse response phase assessments for all microphones.

In some embodiments in the second class, the method includes the following steps:

for each speaker in a room, and for each microphone, driving the speaker with a reference signal and determining the impulse response of the transfer function between the speaker, the room, and the microphone and the reference signal;

time gating the impulse response, using a gated time interval to emphasize first arrival sounds to reduce room effects;

performing minimum phase equalization on the time-gated impulse response to flatten the frequency response (e.g., to reduce response variation effects);

performing coarse delay compensation on the impulse response by finding and using the time delay to the first peak in the impulse response and subtracting this from the phase spectrum of the impulse response (e.g., to remove the linear phase component);

finding the phase spectrum using an FFT (or other time domain-to frequency domain transform);

performing fine delay compensation by unwrapping the phase spectrum and setting the delay to 0 at some high frequency (this can improve delay compensation accuracy when the phase shift of frequencies less than 1 kHz is being used); and determining polarity of the speaker by determining how close the phase is close to 0 or 180 degrees at a particular frequency.

Optionally, for each microphone, polarity may be determined by phases at each of two or more frequencies.

One embodiment in the second class includes the following steps (for each speaker):

applying at least one (typically more than one) linear-phase, 2nd order bandpass filter (each such filter having a pass band centered at a different frequency) to each determined time-gated impulse response for the speaker; and assessing the phase of each bandpass filtered, time-gated impulse response for the speaker (a binary determination, which assesses whether each bandpass filtered, time-gated impulse response is "in phase" or "out of phase" with another one of the filtered, time-gated impulse responses). Each such linear-phase, 2nd order bandpass filter can be combined with a broader bandpass filter with more rapid roll off of the pass band. This preserves the simple impulse response modification by the linear-phase 2nd order bandpass filter, typically with $0.5<Q<3$, and still attenuates more strongly frequency components farther away from the center frequency of the passband of the 2nd order bandpass filter. This type of phase assessment has the advantage that no delay compensation is needed to assess the polarity. The polarity (at each frequency of interest) is determined to be non-inverted (i.e., relative to the polarity of some representative speaker at the frequency) if the absolute level of the maximum peak (or first peak) of a bandpass filtered version of the time-gated impulse response for the speaker (with the pass band centered at the relevant frequency) is positive, and the polarity is determined to be inverted (i.e., relative to the polarity of the representative speaker at the frequency) if the absolute level of the maximum peak (or first peak) of the bandpass filtered version of the time-gated impulse response corresponds to a negative value.

Another embodiment in the second class includes the following steps (for each speaker):

determining the delay of each bandpass filtered, time-gated impulse response for the speaker (i.e., the time of occurrence of the first positive peak of the bandpass-filtered impulse response relative to the time of audio pulse emission), and determining a phase shift for said each bandpass filtered, time-gated impulse response, and assessing the phase shift values(s) at each frequency of interest (i.e., the center frequency of one of the passbands). The final polarity score can be either based on the mean of the phase shift at all frequencies assessed, for the impulse response results from each microphone, or by a majority vote of the assessed polarities for all of the microphones. The polarity at each frequency is determined to be non-inverted (relative to the polarity of some representative speaker) if the delay (phase of the positive peak of the bandpass-filtered impulse response relative to the phase of the emitted audio pulse) is in the range $-90$ deg$\leq$phase$<90$ deg, and the polarity at the frequency is determined to be inverted (relative to the polarity of the representative speaker) if the delay (phase of the positive peak of the bandpass-filtered impulse response relative to the phase of the emitted audio pulse) is in the range 90 deg$\leq$phase$\leq$180 deg, or the range $-180$ deg$\leq$phase$<-90$ deg.

In some embodiments in the second class, the inventive method includes the steps of:

1. driving each of the speakers in turn with a wideband stimulus, capturing resulting sound emitted from each of the speakers using one or more microphones, and recording the captured audio (the output of each microphone) in clock synchrony with the assertion of the wideband stimulus to the sequence of speakers;

2. determining the impulse response from each speaker to each microphone from the captured audio (e.g., the raw recordings). The averaging implicit in this operation helps suppress any noise present in the recordings, although room reverberation is preserved;

3. time gating each impulse response starting from first arrival sound to remove or reduce the effect of reflections and reverberation. Typical durations of the time gate range from 2-20 ms;

4. for each time-gated impulse response, generating a frequency response by performing a time domain-to frequency domain transform on the time-gated impulse response (typically including by zero padding the time-gated impulse response to a longer power of two length, typically 2048 samples, and performing a FFT (or other time domain-to frequency domain transform) on the zero-padded, time-gated impulse response);

5. for each said frequency response, generating a flattened frequency response by applying minimum-phase flattening to the frequency response. Step 5 can include the steps of:

(a) applying fractional-octave RMS box-car smoothing to the frequency response (typically $1/24$th octave smoothing);

(b) inverting the smoothed response and applying a zero order hold to the inverted response below and above user defined frequencies, e.g., 20 and 20,000 Hz, respectively. This creates the frequency magnitude values of the equalization function;

(c) finding the phase values for the minimum-phase equalization function of the frequency magnitude values (determined in step (b)) using the Hilbert Transform of natural logarithm of said frequency magnitude values; and (d) multiplying the phase values determined in step (c) with the coefficients of the frequency response on a coefficient by coefficient basis);

6. for each said flattened frequency response, multiplying coefficients of the flattened frequency response with frequency coefficients associated with a linear phase 2nd order bandpass filter;

7. for each said flattened frequency response, multiplying the output of step 6 with frequency coefficients associated with a broader bandpass filter having sharper roll off (e.g., by setting to zero the transform coefficients at frequencies less than 0.2 times and greater than 5 times the center frequency of the 2nd order band pass filter);

8. performing a frequency domain-to-time domain transform (e.g., an inverse FFT) on the output of step 7, to determine the processed impulse response in the time domain.

9. assessing the polarity of the maximum absolute level of the processed impulse response.

10. repeating steps 6-9 for as many 2nd order bandpass filters as required (i.e., for each frequency at which polarity is to be determined);

11. repeating steps 3-10 for each microphone signal assessed; and 12. determining the polarity at each frequency of each speaker by taking a majority vote or weighted average of all the results of step 11 for the frequency and the speaker.

In other embodiments in the second class of embodiments, the method includes the steps of:

1. driving each of the speakers in turn with a wideband stimulus, capturing resulting sound emitted from each of the speakers using one or more microphones, and recording the captured audio (the output of each microphone) in clock synchrony with the assertion of the wideband stimulus to the sequence of speakers;

2. determining the impulse response from each speaker to each microphone from the captured audio (e.g., the raw recordings). The averaging implicit in this operation helps suppress any noise present in the recordings, although room reverberation is preserved;

3. time gating each impulse response starting from first arrival sound to remove or reduce the effect of reflections and reverberation. Typical durations of the time gate range from 2-20 ms;

4. for each time-gated impulse response, generating a frequency response by performing a time domain-to frequency domain transform on the time-gated impulse response (typically including by zero padding the time-gated impulse response to a longer power of two length, typically 2048 samples, and performing a FFT (or other time domain-to frequency domain transform) on the zero-padded, time-gated impulse response);

5. for each said frequency response, generating a flattened frequency response by applying minimum-phase flattening to the frequency response. Step 5 can include the steps of:

(a) applying fractional-octave RMS box-car smoothing to the frequency response (typically 1/24th octave smoothing);

(b) inverting the smoothed response and applying a zero order hold to the inverted response below and above user defined frequencies, e.g., 20 and 20,000 Hz, respectively. This creates the frequency magnitude values of the equalization function;

(c) finding the phase values for the minimum-phase equalization function of the frequency magnitude values (determined in step (b)) using the Hilbert Transform of natural logarithm of said frequency magnitude values; and (d) multiplying the phase values determined in step (c) with the coefficients of the frequency response on a coefficient by coefficient basis);

6. finding the phase of each time-gated impulse response after coarse time delay correction (this step can include the steps of: (a) performing a frequency domain-to time domain transform (e.g., an inverse FFT) on each said flattened frequency response to derive a time-domain version of the impulse response;

(b) determining the time delay to the maximum absolute value of the impulse response;

(c) generating a unit impulse at this derived time delay;

(d) performing a time domain-to frequency domain transform (e.g., a FFT) of the unit impulse; and (e) performing frequency-domain coefficient by coefficient division of the gated time impulse over the unit impulse);

7. finding the phase of the time delay corrected frequency-domain coefficients generated in step 6;

8. unwrapping the phase of the output of step 7;

9. finding the phase shift at 20,000 Hz;

10. applying linear phase versus frequency correction to make the phase shift at 20,000 Hz equal to 0; and 11. rewrapping the phase to ±180 deg.

Optionally, the following step is also performed:

12. applying fractional octave smoothing via taking the mean value using a box-car averaging process, typically 1/3 octaves.

After step 11, or after step 12 (if step 12 is performed), the following steps are performed:

13. assessing the phase shift at one or more frequencies;

14. either finding the mean phase shift and then determining overall polarity or taking a majority vote or weighted average of the polarity scores determined by the phase values;

15. repeating steps 1-14 for all microphone signals assessed; and 16. taking the majority vote or weighted average to assess the polarity at each frequency of interest of each speaker.

In a third class of embodiments of the inventive method, polarity of speakers of a playback system is determined using a peak tracking technique (to determine the first peak of an impulse response which has been measured for each speaker). Programmed processor 2 of FIG. 3 can be programmed to perform such an embodiment to determine relative polarities of speakers installed in room 1 (or of individual drivers of one or more such speakers). Each method in this class includes steps of driving a speaker with a wideband stimulus, capturing the resulting emitted sound using a microphone, determining an impulse response (from the speaker to the microphone) from the captured audio, and determining polarity of the speaker by determining the sign of the first peak of the impulse response whose amplitude has an absolute value which exceeds a predetermined threshold. The method determines absolute polarity of each speaker, if it is known or assumed that a positive going first peak in the direct part of the impulse response for a speaker corresponds to positive polarity and a negative going first peak in the direct part of the impulse response for the speaker corresponds to a negative polarity (assuming a positive polarity microphone). Each method in this class also provides an indication of the quality of each impulse response based on inter-microphone loudspeaker-room impulse response analysis. In typical implementations, the quality of each impulse response used to determine polarity is determined by an iteration index (' j+1") which indicates the number of iterations required for iterative determination of the impulse response's first peak. Typically, the threshold is determined from the first few milliseconds before the arrival of the direct sound (in the silent or noisy part of the impulse response before the arrival of the direct sound) and can be obtained either from the raw impulse response measurement or from the energy-time curve which is a plot of the response magnitude in dB versus time of the impulse response. In one aspect, the threshold can be set as the maximum of the absolute value of the silent/noisy-part of the impulse response. To reduce the influence of noise that can impact the threshold estimate, a moving average filter or other smoothing scheme can be utilized as a pre-processing step for the impulse response.

Typical embodiments in the third class include the steps of:

(a) driving a speaker with a wideband stimulus, and capturing resulting sound emitted from the speaker using at least one microphone, thereby generating an output signal for each said microphone;

(b) for each said microphone, determining from the microphone's output signal a sequence of audio values indicative of an impulse response (from the speaker to the microphone);

(c) from each said sequence of audio values, determining polarity of the speaker by determining the sign of the first peak (indicated by the sequence) whose amplitude has an absolute value exceeding a predetermined threshold; and (d) determining a measure of quality of the impulse response, wherein step (c) includes the steps of:

(e) determining a subset of the values in the sequence such that each value in the subset has an absolute value exceeding the predetermined threshold value, and determining a time (e.g., a time index identifying one of the values) corresponding to a value in the subset which has a maximal absolute value (i.e., determining the time corresponding to a value in the subset which has absolute value equal to or greater than the absolute value of all other the values in the subset); and (f) generating a reduced subset of the values by discarding all values in the subset corresponding to times later than the time determined in step (e) until the reduced subset consists of a single value, identifying said single value as the first peak indicated by the sequence, and determining the sign of said single value (typically, if the reduced subset consists of at least two values after performing an iteration of subset reduction, again performing steps (e) and (f) but on the reduced subset of the values, and performing a sufficient number of iterations of steps (e) and (f) on values in the reduced subset to determine a further reduced subset of the values which consists of a single value of the reduced subset, and identifying said single value as the first peak indicated by the sequence and determining the sign of the said single value), and wherein step (d) includes the step of determining a number A*(j+1)+B, where j is the number of iterations of steps (e) and (f) performed to determine the reduced subset (e.g., the further reduced subset) of the values which consists of a single value of the reduced subset, * denotes multiplication, and A and B are non-negative numbers (e.g., A=1 and B=0), and identifying the number A*(j+1)+B as the measure of quality of the impulse response.

An exemplary embodiment in the third class includes the steps of:

(a) driving a speaker with a wideband stimulus;

(b) capturing the resulting emitted sound using at least one microphone;

(c) determining an impulse response, $h_{ki}(n)$, from the "k"th microphone to the "i"th speaker, from the audio output signal of the "k"th microphone, where n is a sample index indicative of time;

(d) normalizing the impulse response $h_{ki}(n)$, to determine a normalized response, $h^{norm}_{ki}(n)$, consisting of values between +1 and −1, by dividing the impulse response $h_{ki}(n)$, by the maximum absolute value of the impulse response $h_{ki}(n)$;

(e) setting a threshold parameter ("threshold");

(f) setting an iteration number j=1, and setting an index vector to a null vector;

(g) initializing a peak tracking variable ("peak value") to unity (+1);

(h) while peak value>threshold:

(1) determining an absolute valued vector $|x_j|$ which is an absolute value of a response vector $x_j$. In the first iteration of substep (h)(1), the response vector $x_j$ is the original impulse response vector $h^{norm}_{ki}(n)$;

(2) sorting the values comprising the absolute valued vector in descending order of amplitude and obtaining the corresponding time index $n_j$ of the maximum of the absolute valued vector $|x_j|$ for the "j"th iteration; and (3) choosing the response vector $x_j$ (to be used in the next iteration of substep (h)(1)) as values of the normalized impulse response vector $h^{norm}_{ki}(n)$ consisting of the first value through value $n_j-1$; and (4) setting j=j+1;

(i) selecting the most recently updated value index $n_j$ upon exiting from the "while" loop (i.e., upon completing step (h));

(j) evaluating the sign of the value of $h^{norm}_{ki}(n)$ having the sample index $n_j$ selected in step (i), and determining that speaker polarity is correct (or in phase) if the sign is positive, or determining that speaker polarity is incorrect (or out-of-phase) if the sign is negative.

In variations on the exemplary embodiment, step (h) is replaced by a similar step in which the "sorting" operation (substep (h)(2) above) is omitted, and the time index $n_j$ of the maximum value is otherwise determined. Step (h)(3) above essentially discards all values with time values greater than $n_j-1$. Thus, the method converges (after several iterations, each having a different index j, on the first (lowest time value) value of the impulse response which exceeds the threshold.

The iteration index j of the sample index $n_j$ selected in step (i) can be used to indicate the quality (e.g., reliability) of the impulse response. It has been observed that if any of the measured impulse responses results from a corrupted measurement, the iteration index j of the sample index $n_j$ selected in step (i) (sometimes referred to herein as peak finding iteration "$j_{corrupted}$") is typically equal to $(S)*j_{uncorrupted}$, where S is an integer equal to 2, 3 or 4 (typically S=3 or 4), and "$j_{uncorrupted}$" is the iteration index j of the sample index $n_j$ selected in step (i) when none of the measured impulse responses results from a corrupted measurement. Accordingly a metric for checking the quality of a measured impulse response for microphone position p (i.e., measured using a microphone at position "p") and a measured impulse response for microphone position q (i.e., measured using a microphone at position "q") is $\partial p,q=|j_p-j_q|$. It has been observed in cinema environments that $j_{uncorrupted}$ typically has a value in the range from 4 through 6. Thus, if all the impulse responses measured for a speaker (using one microphone, or two or more microphones at different positions) have an iteration index j (the iteration index j of the sample index $n_j$ selected in above-described step (i)) in the range from 12 through 24, this result indicates a corrupt impulse response set for the speaker. In this case, a flag can be set to indicate that all responses for the speaker should be remeasured upon correcting any identified problems.

Some embodiments in the third class determine polarity of an individual driver (e.g., a woofer) of a multi-driver loudspeaker (e.g., one including a woofer and at least one other driver) by band-pass filtering the impulse response of the multi-driver loudspeaker, with the pass band corresponding to the frequency range of the driver of interest. Typically the bandpass filtering is performed by convolving the band pass filter with the impulse response in the time domain, and then determining polarity by applying the above-described method to the band-pass-filtered impulse response. The pass band can be determined based on loudspeaker manufacturer specification of the crossover locations and/or by tracking the −3 dB points from the speaker's frequency response. The manufacturer's specification of the loudspeaker may include a crossover frequency which determines the high (upper end) cutoff frequency of the pass band. The −3 dB point of the speaker's frequency response may determine the low (lower end) cutoff frequency of the pass band.

This is useful in order to apply a band-pass filter with low- and high-cutoff frequencies and specific decay rate (x dB/octave) determined either automatically or from manufacturer specification of the loudspeaker. A linear-phase band-pass filter which passes all frequencies with equal group delay in the pass-band can be used to avoid altering the phase response while extracting the woofer-associated impulse response. Appropriate smoothing of the pre-ripple from the use of a fast-decay band-pass filter in the impulse response can be achieved using an n-octave smoothing filter (n=⅓, 1/12 etc.).

Figure 4:
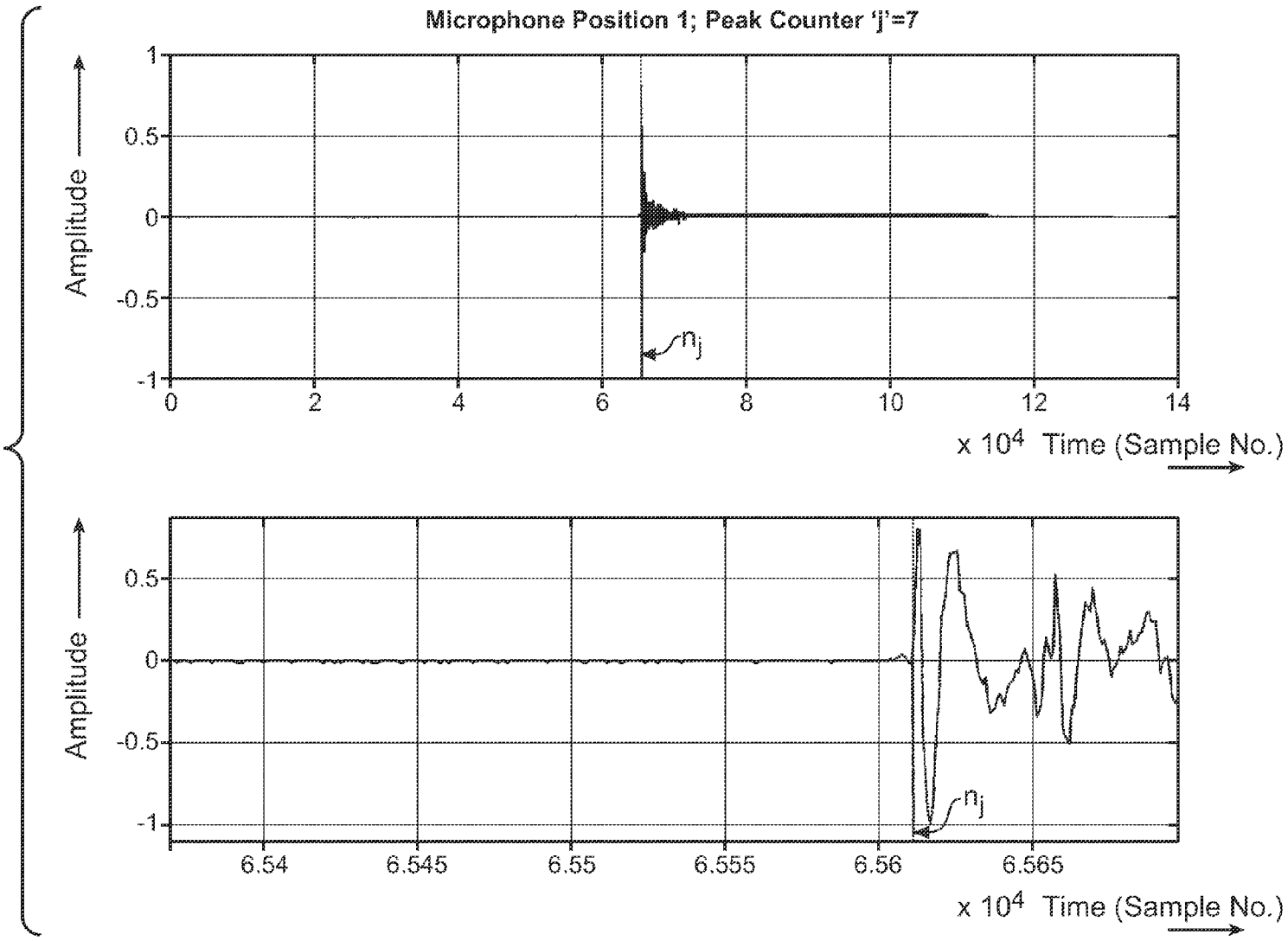
FIG. 4 is a set of two graphs: the top graph is the impulse response (magnitude plotted versus time) of a loudspeaker as measured using a microphone; and the bottom graph is an enlarged version of a portion of the top graph.
Figure 5:
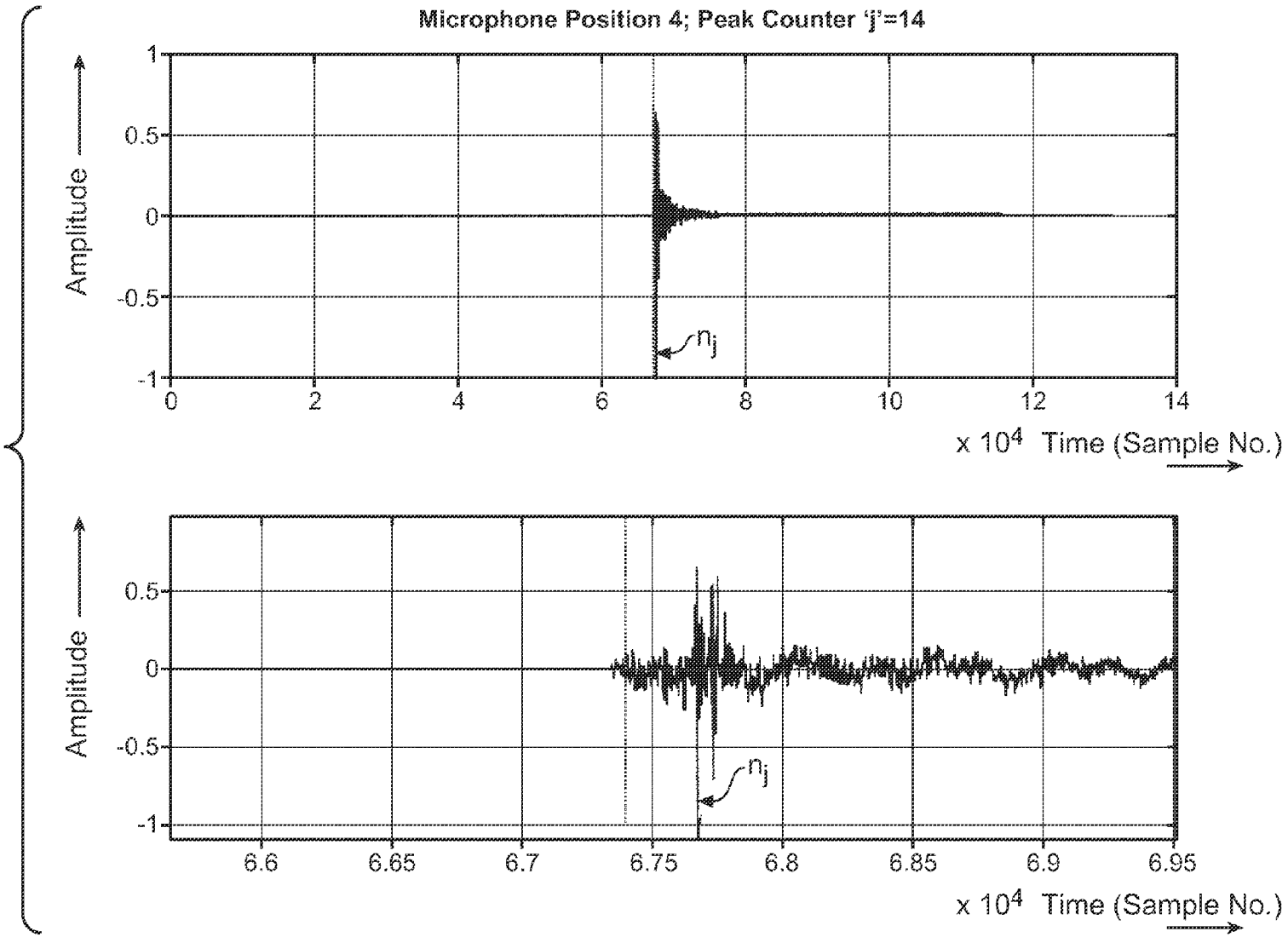
FIG. 5 is another set of two graphs: the top graph is the impulse response (magnitude plotted versus time) of a loudspeaker as measured using a microphone; and the bottom graph is an enlarged version of a portion of the top graph.

One exemplary embodiment of the type described in the previous paragraph was performed on four loudspeakers: three installed in a first movie theater and one installed in a second movie theater. The output of each speaker was measured using four microphones, each microphone at a different position relative to the loudspeaker. The top graph in FIG. 4 is the impulse response (magnitude plotted versus time) of one of the loudspeakers in the first theater as measured using one of the microphones (showing the sample index, $n_j$, at which the first peak was identified), and the bottom graph in FIG. 4 is an enlarged version of a portion of the top graph (also showing the sample index, $n_j$, at which the first peak was identified). Index $n_j$ is the lowest audio sample number at which the response exceeds the threshold value, and occurs in the first (earliest) identified peak in the response. The top graph in FIG. 5 is the impulse response of one of the loudspeakers in the second theater as measured using one of the microphones (showing the sample index, $n_j$, at which the first peak was identified), and the bottom graph in FIG. 5 is an enlarged version of a portion of this top graph (also showing the sample index, $n_j$, at which the first peak was identified). In this figure also, index $n_j$ is the lowest audio sample number at which the response exceeds the threshold value, and occurs in the first (earliest) identified peak in the response. In the example, the following values of the iteration index, j, of the sample index, $n_j$, at which the first peak was identified, and polarity of the first peak, were obtained:

first speaker in first theater: first microphone: positive polarity, j=7 (this is the result indicated in FIG. 4); second microphone: positive polarity, j=6; third microphone: positive polarity, j=6; and fourth microphone: positive polarity, j=7;

second speaker in first theater: first microphone: positive polarity, j=14; second microphone: negative polarity, j=15; third microphone: negative polarity, j=16; and fourth microphone: negative polarity, j=17;

third speaker in first theater: first microphone: positive polarity, j=6; second microphone: positive polarity, j=4; third microphone: positive polarity, j=6; and fourth microphone: negative polarity, j=14; and speaker in second theater: first microphone: negative polarity, j=7; second microphone: negative polarity, j=6; third microphone: negative polarity, j=6; and fourth microphone: negative polarity, j=7 (this is the result indicated in FIG. 5).

The measurements of the second speaker in first theater are deemed to be corrupted, as indicated by the high values (14, 15, 16, and 17) of the iteration index, j, which are about twice those for the uncorrupted measurements of the first speaker in first theater. The measurement of the third speaker in first theater (with the fourth microphone) is deemed to be corrupted, as indicated by the high value (14) of the iteration index, j, which is about 2-3 times the values (j=6, 4, and 6) for the uncorrupted measurements of the same speaker with the other microphones.

In general, when assessing polarity of a speaker with impulse responses measured using several microphones, too much variation of the iteration index, j, from microphone to microphone indicates that the output of at least one microphone is corrupted.

The following Matlab code was employed to program a processor to perform the above-described exemplary embodiment of the inventive method (performed on four loudspeakers: three installed in a first movie theater and one installed in a second movie theater):

```
clear all
close all
[x1,fs]=wavread('Speaker Number and Microphone Number');
x2=x1/max(abs(x1));
x_orig=x2;
threshold=0.1;
buf=[ ];buf_ind=[ ];
y(1)=1;iter=1;x1a=x_orig;
while y(1)>threshold
   x=abs(x1a);
   [y,ind]=sort(x,1,'descend');
   x1a=x_orig(1:ind-1);
   buf=[buf;y(1)];buf_ind=[buf_ind;ind(1)];
   iter=iter+1;
end
length_buf_ind=length(buf_ind);
if x_orig(buf_ind(length_buf_ind-1))>0
   sprintf('Positive')
else
   sprintf('Negative')
end
spaced_line=linspace(-1,1,5000);
figure(1)
subplot(2,1,1)
plot(x_orig)
hold on
plot(buf_ind(length_buf_ind-1),spaced_line,'r','LineWidth',0.5)
grid on
subplot(2,1,2)
plot(x_orig)
hold on
plot(buf_ind(length_buf_ind-1),spaced_line,'r','LineWidth',0.5)
grid on
%peak counter
iter.
```

In foregoing Matlab code, "x1" are the normalized values of the impulse response (in the range from −1 to +1), and "fs" are the time values (sample numbers) for these impulse response values. The threshold value was chosen to be 0.1.

Aspects of the invention include a system configured (e.g., programmed) to perform any embodiment of the inventive method, and a computer readable medium (e.g., a disc) which stores code for implementing any embodiment of the inventive method. For example, such a computer readable medium may be included in processor 2 of FIG. 3.

In some embodiments, the inventive system is or includes at least one microphone (e.g., microphone M1 of FIG. 3) and a processor (e.g., processor 2 of FIG. 3) coupled to receive a microphone output signal from each said microphone. Each microphone is positioned during operation of the system to perform an embodiment of the inventive method to capture sound emitted from a set of speakers (e.g., the speakers of FIG. 3) and to determine relative polarities of pairs of the speakers by processing audio data indicate of the captured sound. The processor can be a general or special purpose processor (e.g., an audio digital signal processor), and is programmed with software (or firmware) and/or otherwise configured to perform an embodiment of the inventive method in response to each said microphone output signal. In some embodiments, the inventive system is or includes a processor (e.g., processor 2 of FIG. 3), coupled to receive input audio data (e.g., indicative of output of at least one microphone in response to sound emitted from a set of speakers). The processor (which may be a general or special purpose processor) is programmed (with appropriate software and/or firmware) to generate (by performing an embodiment of the inventive method) output data in response to the input audio data, such that the output data are indicative of relative polarities of pairs of the speakers. In some embodiments, the processor of the inventive system is audio digital signal processor (DSP) which is a conventional audio DSP that is configured (e.g., programmed by appropriate software or firmware, or otherwise configured in response to control data) to perform any of a variety of operations on input audio data including an embodiment of the inventive method.

In some embodiments of the inventive method, some or all of the steps described herein are performed simultaneously or in a different order than specified in the examples described herein. Although steps are performed in a particular order in some embodiments of the inventive method, some steps may be performed simultaneously or in a different order in other embodiments.

While specific embodiments of the present invention and applications of the invention have been described herein, it will be apparent to those of ordinary skill in the art that many variations on the embodiments and applications described herein are possible without departing from the scope of the invention described and claimed herein. It should be understood that while certain forms of the invention have been shown and described, the invention is not to be limited to the specific embodiments described and shown or the specific methods described.

What is claimed is:

1. A method for determining relative polarities of a set of N speakers in a playback environment using a set of M microphones in the playback environment, where M is a positive integer and N is an integer greater than one, said method including steps of:

(a) measuring impulse responses, including an impulse response for each speaker-microphone pair;

(b) clustering the speakers into a set of groups, each group in the set including at least two of the speakers which are similar to each other in at least one respect; and (c) for each said group, determining cross-correlations of pairs of the impulse responses of speakers in the group and determining relative polarity of the speakers in said group from the cross-correlations.

2. The method of claim 1, wherein step (c) includes a step of determining, for each said group, a peak value of the cross-correlation of each pair of impulse responses corresponding to two speakers in the group, determining that the two speakers are in phase upon determining that the peak value is positive and exceeds a predetermined positive threshold value, and determining that the two speakers are out of phase upon determining that the peak value is negative and has an absolute value which exceeds the predetermined positive threshold value.

3. The method of claim 1, wherein said each microphone generates an analog output signal, and step (a) includes a step of sampling each said analog output signal to generate the audio data.

4. The method of claim 1, wherein step (c) includes performing band-pass filtering on at least some of the impulse responses to generate band-pass filtered responses, and determining cross-correlations of pairs of the band-pass filtered responses of speakers in at least one said group.

5. The method of claim 1, wherein step (c) includes time windowing of at least some of the impulse responses to generate windowed responses, and determining cross-correlations of pairs of the windowed responses of speakers in at least one said group.

6. The method of claim 1, wherein step (c) includes performing frequency-dependent weighting on frequency bands of at least some of the impulse responses to generate weighted responses, and determining cross-correlations of pairs of the weighted responses of speakers in at least one said group.

7. The method of claim 1, wherein step (a) includes the steps of:

driving each of the speakers with a wideband stimulus, obtaining audio data indicative of sound captured by each of the microphones during emission of sound from each driven speaker, and determining the impulse responses by processing the audio data.

8. A system for determining relative polarities of a set of N speakers, where N is an integer greater than one, said system including:

a set of M microphones, where M is a positive integer and each of the microphones is configured to produce an output signal in response to incident sound; and a processor, configured to be coupled to receive the output signal of each of the microphones and to process audio data determined from each said output signal to determine the relative polarities of the speakers, including by:

determining impulse responses, including an impulse response for each speaker-microphone pair, by processing the audio data, clustering the speakers into a set of groups, each group in the set including at least two of the speakers which are similar to each other in at least one respect; and for each said group, determining cross-correlations of pairs of the impulse responses of speakers in the group and determining relative polarity of the speakers in said group from the cross-correlations, wherein the audio data are indicative of sound, emitted from each of the speakers in response to driving said each of the speakers with a wideband stimulus, and captured by each of the microphones.

9. The system of claim 8, wherein the processor is configured to determine, for each said group, a peak value of the cross-correlation of each pair of impulse responses corresponding to two speakers in the group, to determine that the two speakers are in phase upon determining that the peak value is positive and exceeds a predetermined positive threshold value, and to determine that the two speakers are out of phase upon determining that the peak value is negative and has an absolute value which exceeds the predetermined positive threshold value.

10. The system of claim 8, wherein the processor is configured to perform band-pass filtering on at least some of the impulse responses to generate band-pass filtered responses, and to determine cross-correlations of pairs of the band-pass filtered responses of speakers in at least one said group.

11. The system of claim 8, wherein the processor is configured to time window at least some of the impulse responses to generate windowed responses, and to determine cross-correlations of pairs of the windowed responses of speakers in at least one said group.

12. The system of claim 8, wherein the processor is configured to perform frequency-dependent weighting on frequency bands of at least some of the impulse responses to generate weighted responses, and to determine the cross-correlations such that said cross-correlations are of pairs of the weighted responses of speakers in at least one said group.

* * * * *